US007975437B2

(12) United States Patent
Byrd

(10) Patent No.: US 7,975,437 B2
(45) Date of Patent: Jul. 12, 2011

(54) PLAYGROUND ROOF SUPPORT

(75) Inventor: Daniel V. Byrd, Ft. Payne, AL (US)

(73) Assignee: Playcore Wisconsin, Inc., Chattanooga, TN (US)

( * ) Notice: Subject to any disclaimer, the term of this patent is extended or adjusted under 35 U.S.C. 154(b) by 1645 days.

(21) Appl. No.: 10/961,238

(22) Filed: Oct. 8, 2004

(65) Prior Publication Data

US 2006/0096188 A1 May 11, 2006

(51) Int. Cl.
*E04B 7/02* (2006.01)

(52) U.S. Cl. ..... 52/90.1; 446/110; 472/136

(58) Field of Classification Search ..... 52/79.1, 52/79.6, 19, 82, 90.1; 446/110, 121, 476, 446/478, 479, 482; 403/263, 381; 472/136; 297/142

See application file for complete search history.

(56) References Cited

U.S. PATENT DOCUMENTS

| | | | | |
|---|---|---|---|---|
| 3,774,357 | A * | 11/1973 | Moore | 52/36.2 |
| 5,706,613 | A * | 1/1998 | Drake et al. | 52/79.1 |
| 5,819,479 | A * | 10/1998 | Rodriguez-Ferre | 52/79.4 |
| 6,796,087 | B1 * | 9/2004 | Greene | 52/32 |
| 7,182,713 | B2 * | 2/2007 | Wang et al. | 482/35 |
| 2003/0162611 | A1 * | 8/2003 | Steed et al. | 473/481 |

* cited by examiner

*Primary Examiner* — Basil Katcheves
*Assistant Examiner* — Branon Painter
(74) *Attorney, Agent, or Firm* — Stephen J. Stark; Miller & Martin PLLC

(57) ABSTRACT

A playground roof system having the capability of being attached to different diameter support members is provided. The frame of the roof structure is roto-molded such that two different sized openings are provided at each corner of the frame, each opening in the same area, such that the roof is interchangeable in different playground systems. The roof system further includes openings formed in the frame such that a fastener can be threaded therein fastening the frame and support members together.

10 Claims, 6 Drawing Sheets

PLAYGROUND ROOF SUPPORT

FIELD OF THE INVENTION

The present invention concerns a system to support a roof for use on large playground climbing equipment. More particularly the present invention concerns a modular roofing frame structure that permits the user to utilize different sized support legs to support a roof over sections of a play area or feature in playground equipment. In this manner the same roof system model can be used for different playground set ups and with different sized support systems.

In the present invention, the roof is constructed of a frame having means to attach a roof section, which can be changed or modified to change the character of the play area. The modular roof section being attachable from beneath a frame support such that modifications, changes and repairs are simplified and made safer to construct. The frame is molded with an opening having different molded sub-openings providing different anchorages for different sized supports.

BACKGROUND OF THE INVENTION

Large playground equipment has become prevalent both in public playgrounds and in private back yards with sections of the equipment designed to look like forts, castles and houses, among others. Some playground equipment has been made in the same manner that roofing on housing is made, causing complex and expensive construction. Roofing for such playground set ups including the creation of a substructure to hold the roofing in position, the creation of a frame, soffits and fascia and then the installation of a roof thereon. Typically, as in a real roof, the workers are required to place themselves above the structure to create and install the roofing. In situations where the roof has been created at ground level, or has been molded of plastic, and then placed on a frame, the workers have still had to be above and outside of the supporting structure to install the roof.

I have discovered a method of providing a simple support structure, a roof support system and a modular roof design such that a roof can be installed on a playground system. In the present invention, the roof can be installed from within the structure such that the worker never has to place himself above the structure and into jeopardy. Further, the roof is made in modular sections permitting easy installation and removal and re-installation of a different shaped module such that the design and shape of the roof can be changed quickly and easily. The roof further can fit into a theme, such as a Mediterranean theme by having a Spanish-style tile roof, so that different types of playgrounds, fitting different themes can be built quickly and efficiently.

SUMMARY OF THE INVENTION

In accordance with the present invention, a playground roof support system is provided comprising a support structure for holding up a roof in a playground system and a frame structure, having an inner perimeter, preformed with fascia and soffits. In a preferred embodiment of the present invention, the frame is attachable to the support structure and a modular roof section attachable to the inner perimeter of the frame structure from within the frame structure. In this manner the roof section can be installed, onto the frame, from below the frame and support structure. Further, the invention provides an opening, formed within the frame structure, such that supports of at least one of two outer diameters can be placed in one of two positions formed in each opening, such that supports of different sizes, as specified for the playground structure, can be used with the same roof structure provided.

In order to facilitate the creation of such a playground, the roof support further includes supports opening formed such that a larger diameter support may be fitted in a lower section and a smaller diameter support may be fitted in a higher section, the higher section being fitted with the lower section. Further, the playground roof support system, in a preferred embodiment is comprised of roto-molded member having the support openings molded therein.

The playground roof support system further includes at least one fastener opening formed within the frame such that when the support is fitted within the support opening a fastener can be inserted within the fastener opening so as to secure the support to the frame. In a preferred embodiment, the playground roof support system defines two fastener openings such that each of the different diameter support openings has a separate fastener opening.

A more detailed explanation of the invention is provided in the following description and claims and is illustrated in the accompanying drawings.

DETAILED DESCRIPTION OF THE ILLUSTRATIVE EMBODIMENT

Figure 1:
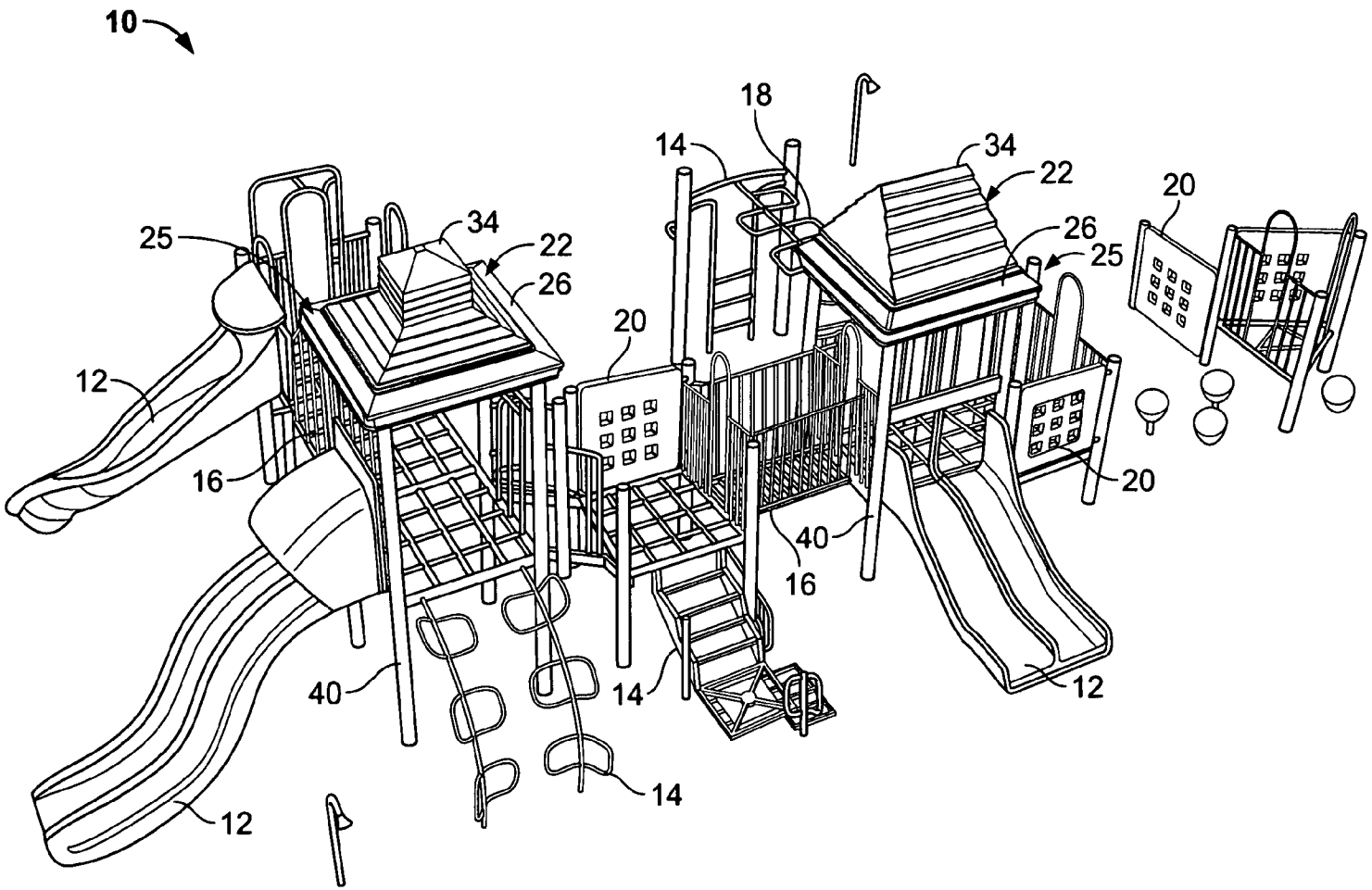
FIG. 1 is a perspective view of a playground having roofing structures made in accordance with the teachings of the present invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of the Illustrative Embodiment") relates to a requirement of the United States Patent Office, and should not be found to limit the subject matter disclosed herein.

Referring to the drawings, FIG. 1 shows a typical playground system 10, such as those manufactured by Game-Time, a division of Playcore Wisconsin, Inc., of Janesville, Wis., assignee of the present invention. System 10 includes such play equipment as slides 12, climbing equipment 14, elevated walkways 16, monkey bars 18, play panels 20 and roofing structures 22.

Roof structures 22 of the present invention are uniquely designed to permit the user to easily provide shelter and thematic development for a playground system 10. For example, certain roofing shapes can evoke different play and themes. A pagoda roof evokes the far east, a Spanish tile roof can evoke the Mediterranean seaside, a cupola roof, such as that shown in FIG. 9, can evoke a barn or plantation setting, for example.

Figure 2:
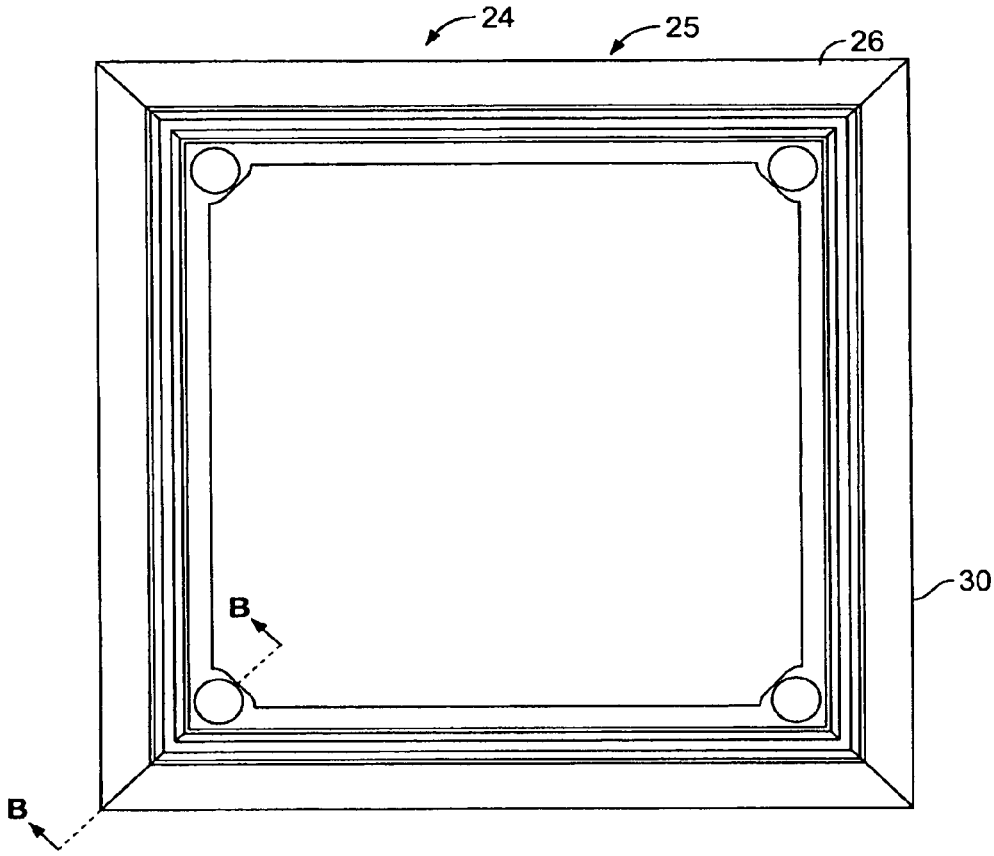
FIG. 2 is a top plan view of the roof support structure of the present invention.
Figure 3:
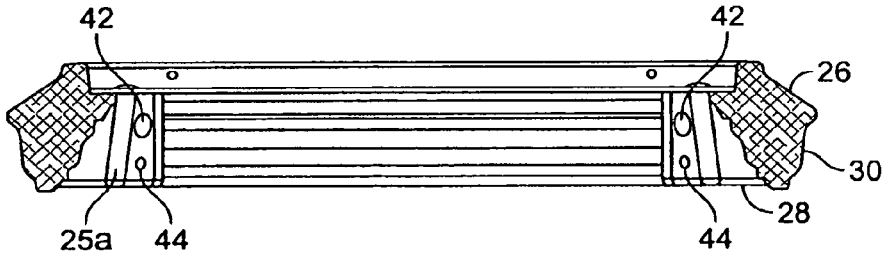
FIG. 3 is a cross sectional view of the roof support structure of FIG. 2, taken along the plane of lines A-A of FIG. 5.

Referring to FIGS. 2 and 3, a substructure 24 of the roofing system 23 of the present invention is shown. Substructure 24 is, in a preferred embodiment, a roto-molded frame 25, molded to give the impression of being a combination of gutters 26, sofits 28 and fascia 30 of a roof. Roto-molding for frame 25 and other parts used in the roofing system of the present invention can be done in a process explained in U.S. Pat. No. 5,324,472, assigned to Playcore Wisconsin, Inc., assignee of the present invention. The above noted U.S. patent is incorporated herein as if set forth in it entirety here. It will be understood by persons having ordinary skill in the art, that other methods of manufacturing the components of the roof and playground system 10, of the present invention can be utilized without departing from the novel scope of the present invention.

Figure 5:
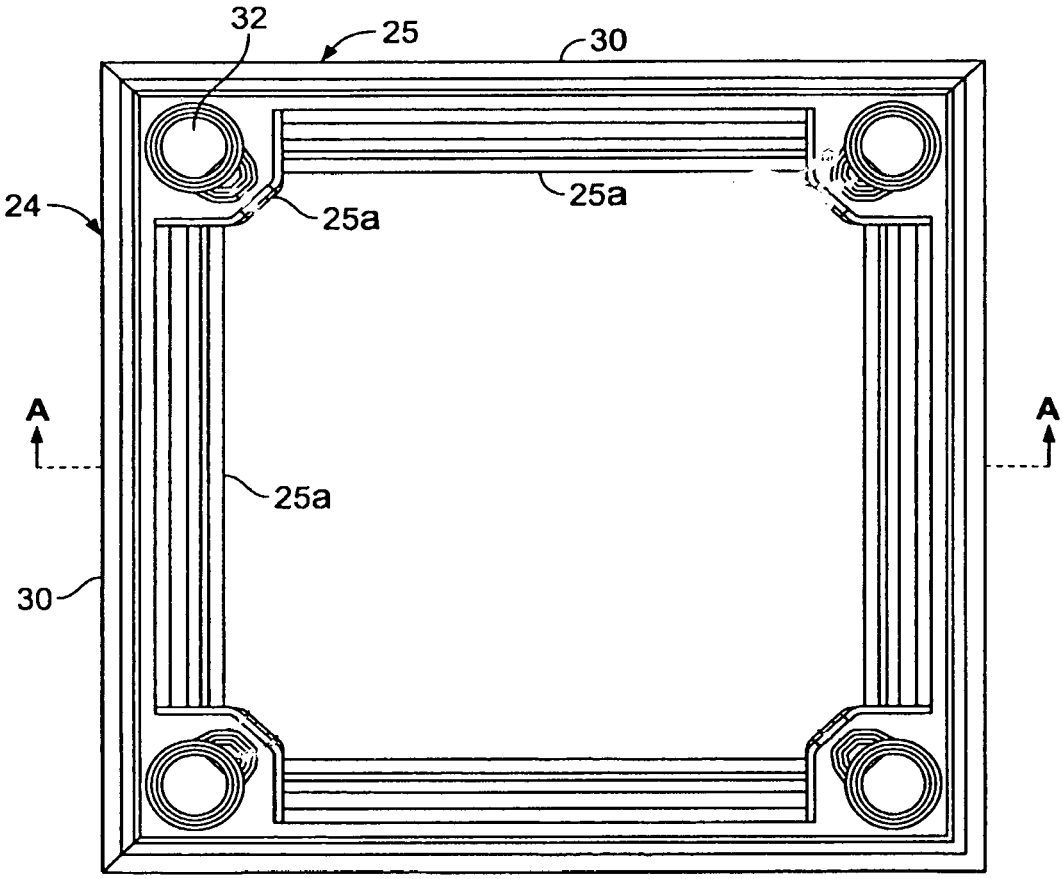
FIG. 5 is a bottom view of the roof support structure of FIG. 2.
Figure 6:
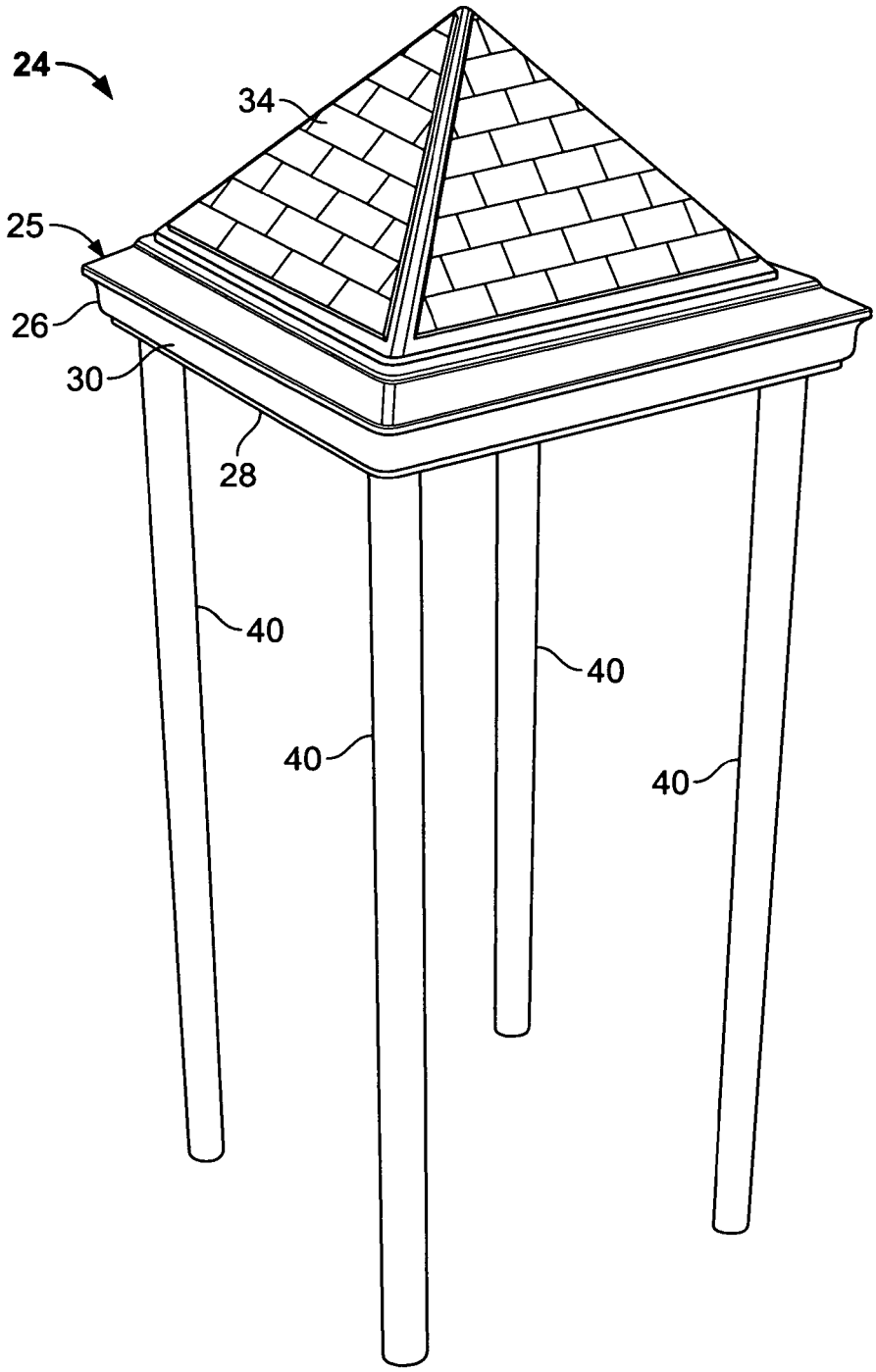
FIG. 6 is a perspective view of a roofing structure made in accordance with the teachings of the present invention.
Figure 7:
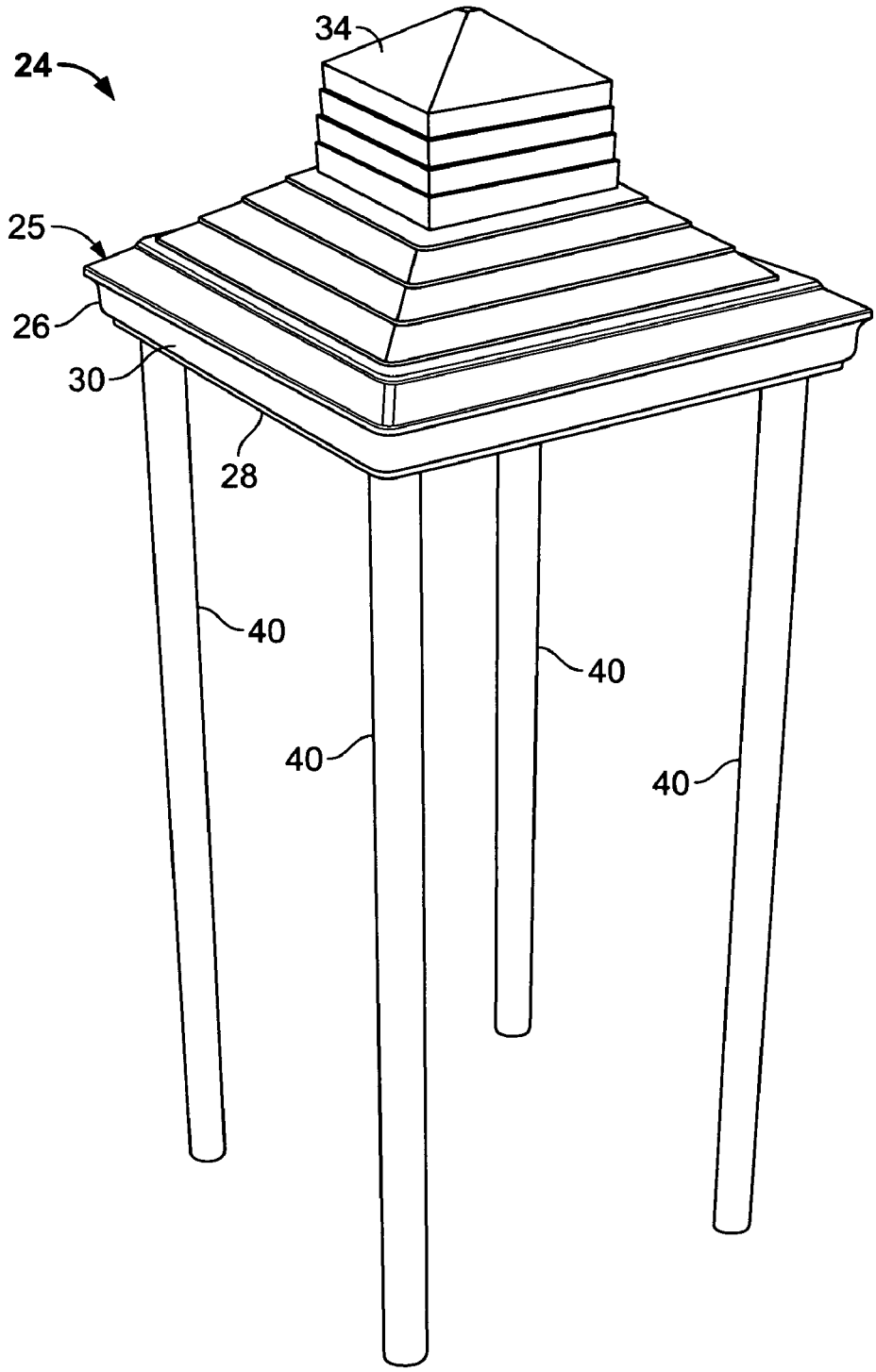
FIG. 7 is a perspective view of a roofing structure made in accordance with the teachings of the present invention.
Figure 8:
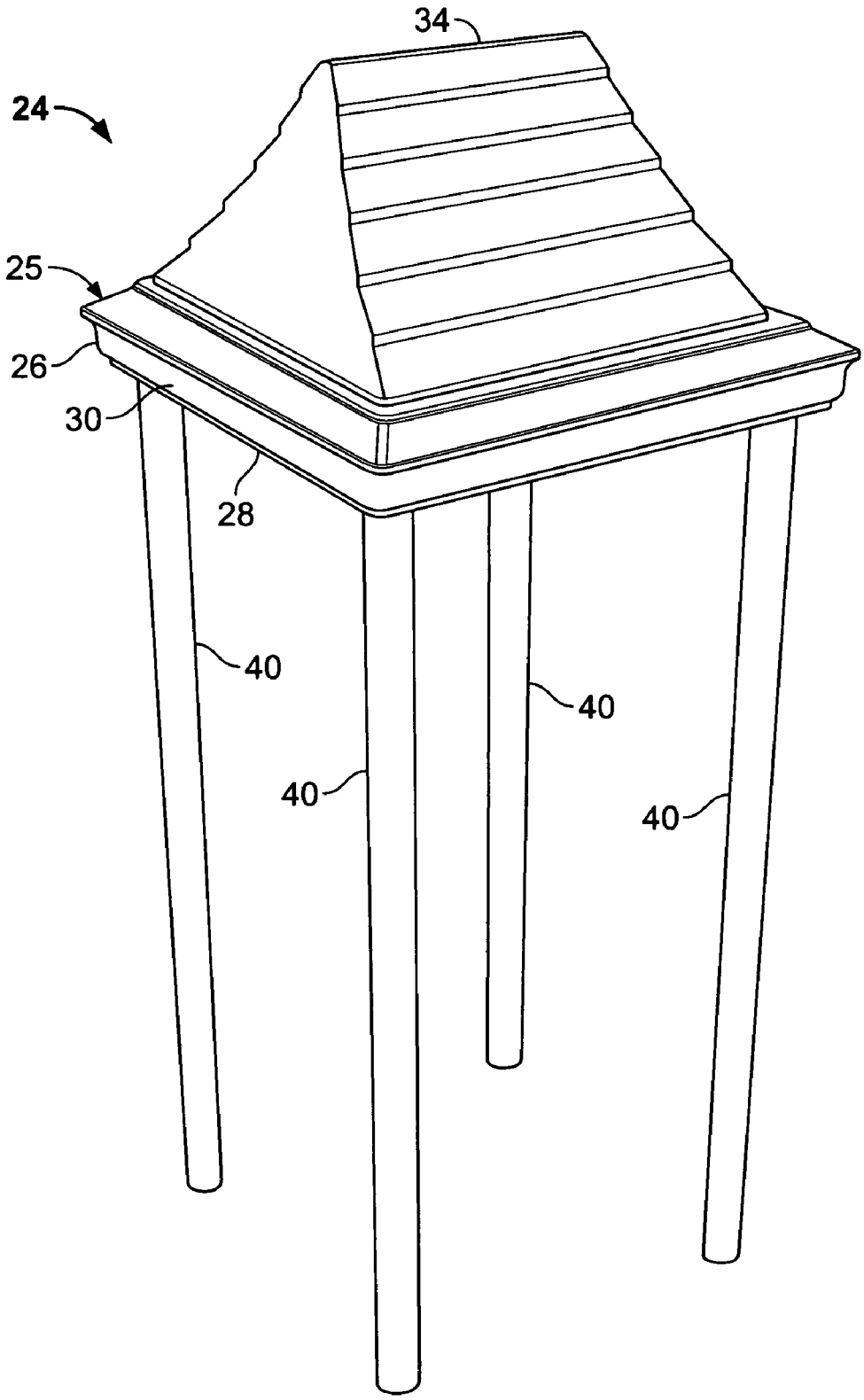
FIG. 8 is a perspective view of a roofing structure made in accordance with the teachings of the present invention.

Frame 25, further, has openings 32, shown in FIG. 5, into which structural support members, not shown, can be inserted to support the roof above a playground system 10. Openings 32 are configured, in a preferred embodiment to provide positions and openings for two different sized support members 40 (FIG. 6), such that the same roof frame 25 can be used with differently sized support members 40. In a preferred embodiment, openings 32 have outer diameters of 5 11/16" and 7 7/16" permitting poles of similar diameters to be used in the support of frame 25. It will be seen that the large support opening 32*a* has within its circumference the opening for the smaller diameter support 32*b*, thereby permitting both to fit within the same area of frame 25. In this manner, frame 25 can be made with a minimal amount of structural material removed to permit insertion of support members 40, so as to maintain the integrity of the structure. As the smaller diameter support opening 32*b* fits within the circumference of the larger opening 32*a*, structural material missing only the area of opening 32*a* is possible.

Figure 4:
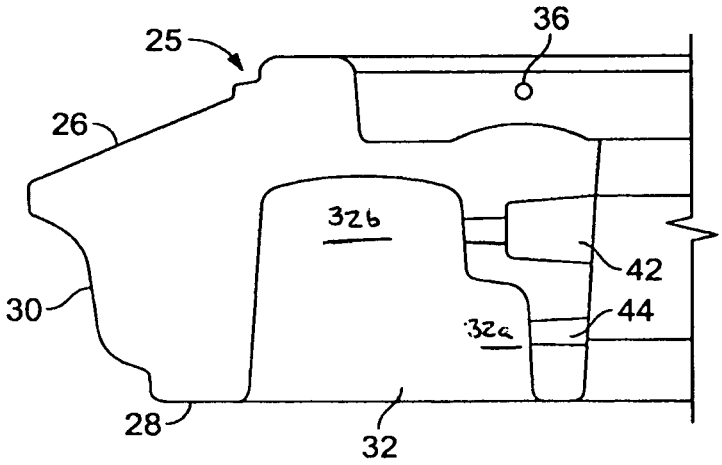
FIG. 4 is another cross sectional view of the roof support structure of FIG. 2, taken along the plane of lines B-B of FIG. 2.

Referring now to FIG. 4, a cross-section of the support opening 32 is shown. It can be seen that the smaller diameter opening 32*b* extends to a higher point within frame 25. An opening 33*b* is formed in frame 25, extending from inner diameter 25*a* to opening 32*b*. Opening 33*b* permits the placement of a tying fastener 50 into frame 25 to secure support member 40 to frame 25. Concomitantly, a second opening 33*a* is also formed in frame 25, extending from inner diameter 25*a* to opening 32*a* so that larger support member 40 can be secured to frame 25 in a similar manner. It will be understood by persons having skill in the art that fasteners 50 can be of any type that is known in the art, including carriage bolts, rivets and other means permitting the attachment of support members 40 to frame 25.

The support of frame 25 and a roof 34, is the subject of Applicant's co-pending patent application, which explains in detail the manner and method of installing such a roof system in or about a playground. It will be seen, and explained in Applicant's co-pending application that frame 25 further defines openings 36 for the attachment of a roof 34 from within and beneath frame 25. In a preferred embodiment, opening 36 contains threading for use with a fastener. It will be understood that various means to attach roof 34 to frame 25 can be utilized without departing from the novel scope of the present invention.

Among the several preferred embodiment, such variations in sizes of support member openings 32 as can accommodate supports 40, generally in the shape of a pipe, having outer diameters of 2⅜ inch or 3½ inch for a frame 25 having a 36 square inch area; a 3½ inch pipe in a frame having a 45.5 square inch area; and a 5 inch pipe for a frame having a 49 square inch area frame. It will be understood by persons having ordinary skill in the art that many other combination of pipe diameters and frame areas are possible without departing from the novel scope of the present invention.

As shown in FIGS. 4 and 5, openings 32 are made so that a support structure, such as legs 40 shown in FIGS. 6-8 and FIG. 1, can be inserted within frame 25 to support the roofing structure 22 of the present invention upright. FIG. 4 clearly shows frame 25 in cross section, showing soffit 28, fascia 30 and gutters 26, as well as one opening 36, into which connections for roof 34 are made. It can be clearly seen, from FIGS. 3 and 4, that roof 34 can be attached to frame 25 from within the inner diameter of frame 25. Further, the connection points, openings 36, are relatively low within the roofing structure to permit easy attachment.

In the construction of a roofing structure 22, a molded frame 25 is connected to legs 40 from within the frame 25 by placing the ends of each of four legs within openings 32 and attaching them with screws, or other fastening means, through openings 42 and 44 in the interior perimeter 25*a* of frame 25. Once frame 25 is attached to legs 40 and the structure is placed upright, a roof 34, of any variety provided can be quickly installed by placing the roof 34 on top of frame 25 and bolting, screwing or otherwise fastening the roof to the frame 25, from within the frame perimeter 25*a*. When desired, roof 34 can be removed and a different type of roof 34 can be attached to frame 25, so as to effect a different type of theme.

Although an illustrative embodiment of the invention has been shown and described, it is to be understood that various modifications and substitutions may be made by those skilled in the art without departing from the novel spirit and scope of the invention.

What is claimed is:

1. A playground roof support system comprising:

a support structure for holding up a roof in a playground system;

a frame structure, having an inner perimeter, defining at least one opening such that supports having at least one of two outer diameters can be placed in one of two positions formed in the at least one opening the frame being attachable to the support structure;

a modular roof section attachable to the inner perimeter of the frame structure from within the frame structure, such that the roof section can be installed, onto the frame, from below the frame and support structure.

2. The playground roof support system of claim 1, wherein the at least one support opening is formed such that a larger diameter support may be fitted in a lower section and a smaller diameter support may be fitted in a higher section, the higher section being fitted within the lower section.

3. The playground roof support system of claim 1, wherein frame member is a roto-molded member and the support openings are molded therein.

4. The playground roof support system of claim 1, wherein the at least one support opening has at least one fastener opening formed therein such that when the support is fitted within the support opening a fastener can be inserted within the fastener opening so as to secure the support to the frame.

5. The playground roof support system of claim 4, wherein the support opening defines two fastener openings such that each of the different diameter support openings has a separate fastener opening.

6. The playground roof support system of claim 1, wherein the frame structure is generally square shaped and a support opening is defined proximate each corner of the square.

7. A playground roof support system comprising:

a support structure for holding up a roof in a playground system;

a generally square shaped, roto-molded plastic, frame structure, having an inner perimeter, preformed with fascia and soffits, defining at least one opening such that supports having at least one of two outer diameters can be placed in one of two positions formed in the at least one opening the frame being attachable to the support structure;

a modular roof section attachable to the inner perimeter of the frame structure from within the frame structure, such that the roof section can be installed, onto the frame, from below the frame and support structure.

8. The playground roof support system of claim 7, wherein the at least one support opening is formed such that a larger diameter support may be fitted in a lower section and a smaller diameter support may be fitted in a higher section, the higher section being fitted within the lower section.

9. The playground roof support system of claim 7, wherein the at least one support opening has at least one fastener opening formed therein such that when the support is fitted within the support opening a fastener can be inserted within the fastener opening so as to secure the support to the frame.

10. The playground roof support system of claim 9, wherein the support opening defines two fastener openings such that each of the different diameter support openings has a separate fastener opening.

* * * * *